US008381945B2

(12) United States Patent
Meyer

(10) Patent No.: US 8,381,945 B2
(45) Date of Patent: Feb. 26, 2013

(54) LIDDED CONTAINER CAPABLE OF WITHSTANDING AN INTERNAL PRESSURE

(75) Inventor: Eran Meyer, Haifa (IL)

(73) Assignee: Darpack Industries Ltd., Or Akiva (IL)

( * ) Notice: Subject to any disclaimer, the term of this patent is extended or adjusted under 35 U.S.C. 154(b) by 1069 days.

(21) Appl. No.: 12/219,105

(22) Filed: Jul. 16, 2008

(65) Prior Publication Data

US 2009/0020545 A1 Jan. 22, 2009

(30) Foreign Application Priority Data

Jul. 17, 2007 (IL) ..... 184665

(51) Int. Cl.
*B65D 41/16* (2006.01)

(52) U.S. Cl. ..... 220/795; 215/270; 220/240; 220/792

(58) Field of Classification Search ..... 220/780, 220/240, 792, 795, 304, 378; 215/270
See application file for complete search history.

(56) References Cited

U.S. PATENT DOCUMENTS

| | | | | |
|---|---|---|---|---|
| 2,754,866 | A * | 7/1956 | Coltman, Jr. | 220/254.3 |
| 3,510,023 | A * | 5/1970 | Klygis et al. | 220/792 |
| 4,117,946 | A | 10/1978 | Kessler | |
| 4,281,774 | A | 8/1981 | Mumford | |
| 4,378,895 | A * | 4/1983 | Woinarski | 220/789 |
| 4,512,493 | A * | 4/1985 | Von Holdt | 220/782 |
| 4,854,472 | A | 8/1989 | Semersky | |
| 4,930,656 | A | 6/1990 | Blanchette | |
| 5,163,576 | A * | 11/1992 | Galer | 220/792 |
| 5,251,770 | A * | 10/1993 | Bartley et al. | 220/240 |
| 5,458,252 | A * | 10/1995 | Logel | 220/240 |
| 5,979,691 | A | 11/1999 | Von Holdt | |
| 2003/0160051 | A1 | 8/2003 | Ciccone | |
| 2005/0269339 | A1 | 12/2005 | Ciccone | |

FOREIGN PATENT DOCUMENTS

| | | |
|---|---|---|
| CH | 672473 | 11/1989 |
| DE | 29515093 | 11/1995 |
| GB | 2093440 | 9/1982 |
| WO | WO 96/16875 | 6/1996 |
| WO | WO 99/58412 | 11/1999 |
| WO | WO 01/19697 | 3/2001 |
| WO | WO 2004/045978 | 6/2004 |

OTHER PUBLICATIONS

Communication Pursuant to Article 94(3) EPC Dated Aug. 6, 2009 From the European Patent Office Re.: Application No. 08160553.7.
Response Dated Dec. 29, 2009 to Communication Pursuant to Article 94(3) EPC of Aug. 6, 2009 From the European Patent Office Re.: Application No. 08160553.7.

(Continued)

*Primary Examiner* — Mickey Yu
*Assistant Examiner* — Chun Cheung

(57) ABSTRACT

A lidded container includes a container having an open top defined by an annular rim; a lid having a central section and an outer rim attachable to the rim of the container; and an annular gasket between the rim and the lid. The annular rim of the lid includes an annular clamping section defined by spaced inner and outer walls for receiving the rim of the container in the space between the walls. The annular clamping section of the lid is integrally joined to the central section of the lid by an annular, elastically deformable juncture section effective to increase (a) the clamping action of the lid clamping section, and (b) the sealing action of the gasket, with an increase in pressure within the container.

9 Claims, 3 Drawing Sheets

OTHER PUBLICATIONS

Communication Pursuant to Article 94(3) EPC Dated Apr. 28, 2010 From the European Patent Office Re. Application No. 08160553.7.

Response Dated Aug. 5, 2010 to Communication Pursuant to Article 94(3) EPC of Apr. 28, 2010 From the European Patent Office Re. Application No. 08160553.7.

Communication Under Rule 71(3) EPC Dated Jan. 26, 2011 From the European Patent Office Re.: Application No. 08160553.7.

The European Search Report and the European Search Opinion Dated Nov. 10, 2008 From the European Patent Office Re.: Application No. 08160553.7.

Office Action Dated Nov. 20, 2011 From the Israel Patent Office Re. Application No. 184665 and Its Translation Into English.

* cited by examiner

LIDDED CONTAINER CAPABLE OF WITHSTANDING AN INTERNAL PRESSURE

RELATED APPLICATION

This Application claims the benefit of Israel Patent Application No. 184665 filed on Jul. 17, 2007, the contents of which are hereby incorporated in its entirety.

FIELD AND BACKGROUND OF THE INVENTION

The present invention relates to lidded containers capable of withstanding an internal pressure. The invention is particularly useful for plastic lidded containers, and is therefore described below with respect to this application.

Containers closed by lids are commonly used in storing and shipping goods, particularly goods in the form of flowable materials, such as liquids, pellets, pastes, powders and the like. Where the container may be subjected to an internal pressure, it is necessary to make the container, and particularly the attachment of the lid to the container, sufficiently strong to withstand such internal pressures. This is particularly problematic with respect to containers made of plastic materials (as distinguished from metal or glass), since plastic generally is more deformable under pressure. Plastic containers are highly susceptible to deformation under pressure, particularly at the attachment of the lid to the container rim, which may result in leakage because of loosening of the lid. Therefore lidded containers, and particularly the area of attachment of the lid to the container, must be made of sufficient thickness to withstand such internal pressure. As a result, the lidded containers are relatively costly to produce because of the added material needed, are relatively costly to transport because of the increased weight, and are environmentally unfriendly because of the relatively large amount of plastic material to be disposed of.

OBJECTS AND BRIEF SUMMARY OF THE PRESENT INVENTION

An object of the present invention is to provide a lidded container having advantages in the above respect. A particular object of the invention is to provide a lidded container having a novel attaching structure between the lid and the container rim capable of withstanding an internal pressure within the container even thought made of relatively thin material.

According to a broad aspect of the present invention, there is provided a lidded container, comprising: a container having a side wall, an integral closed bottom wall, and an open top defined by an annular rim; and a lid having a central section and an outer rim attachable to the rim of the container; said annular rim of the lid including an annular clamping section defined by spaced inner and outer walls, joined together at one end and non-joined at an opposite end, for receiving the rim of the container in the space between the walls: said lidded container further comprises an annular gasket between the rim of the container and the juncture of the inner and outer spaced walls of the clamping section of said lid; said central section of the lid is normally of an outwardly dome-shaped convex configuration; and said one end of the annular rim clamping section of the lid is integrally joined to said central section of the lid by an annular, elastically deformable juncture section effective (a) to increase the clamping action of said clamping section, and (b) the sealing action of said annular gasket with an increase in pressure within the container.

According to further features in the preferred embodiment of the invention described below, the lidded container further includes interengaging ribs on the container rim and the lid, and the annular gasket between the rim of the container and the juncture of the inner and outer spaced walls of the clamping section of the lid.

As will be described more particularly below, a lidded container including the foregoing features may be constructed of relatively thin material, and still have the capability of withstanding relatively high internal pressures.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Figure 1:
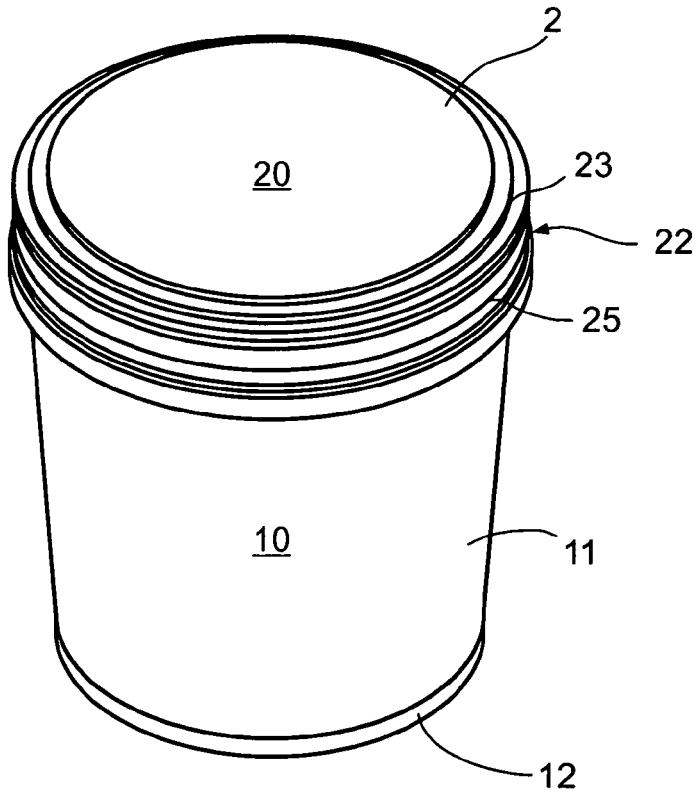
FIG. 1 illustrates one form of lidded container constructed in accordance with the present invention.
Figure 2:
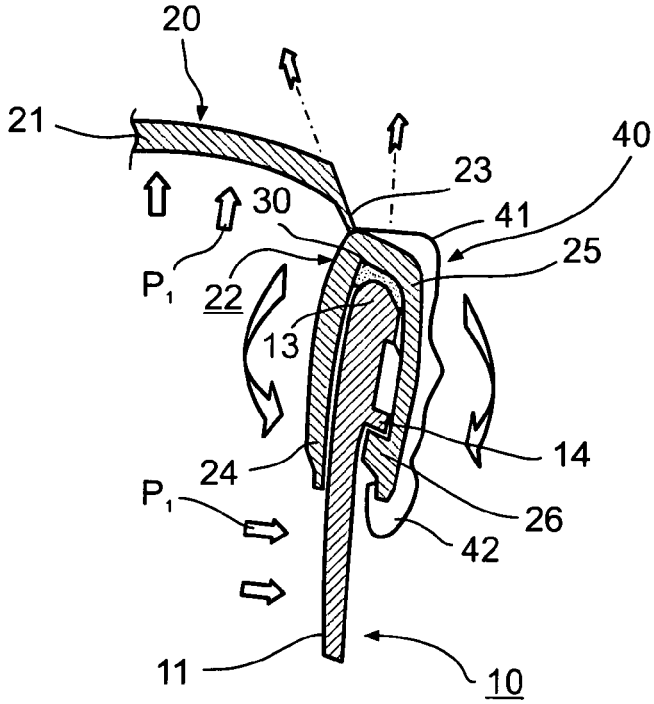
FIG. 2 is an enlarged fragmentary view more particularly illustrating the attaching structure for attaching the lid to the container.

The lidded container illustrated in FIGS. 1 and 2 includes a container, generally designated 10, closed by a lid, generally designated 20. Preferably, both the container and lid are made of a suitable plastic material.

Container 10 includes a side wall 11, an integral closed bottom wall 12, and an upper rim 13 (FIG. 2) defining the open top of the container closed by lid 20. Container 10 further includes an annular rib 14 projecting outwardly from the outer surface of its side wall 11 closely spaced to the container rim 13. As seen particularly in FIG. 2, the upper rim 13 of the container is thickened and rounded, and the outwardly projecting rim 14 is angled slightly towards the container bottom wall 12. However, it may be perpendicular to the side wall, as in the embodiment of FIGS. 3 and 4, described below.

As further seen in FIG. 2, lid 20 includes a relatively thick central section 21, normally of an outwardly dome-shaped convex configuration a clamping section 22 around its outer periphery, and a juncture section 23 between the central section 21 and clamping section 22. Clamping section 22 is constituted of a pair of spaced walls 24, 25 receiving the rim 13 of the container 10 between them. The two walls 24, 25 of clamping 22 are relatively thick, generally corresponding to the thickness of the central lid section 21, whereas the annular juncture section 23, between the clamping section 22 and the central section 21, is relatively thin, so as to be elastically deformable under pressure. Central lid section 21 may be flat or concave, rather than convex as shown, and wall 24 may be longer or shorter than shown in FIG. 3.

The outer wall 25 of the lid clamping section 22 is formed, on its inner surface, with an inwardly projecting rib 26 to engage the outwardly protecting rib 14 of the container. Rib 26 of the lid is angled upwardly towards the rim of the container so as to firmly engage rib 14 of the container when the clamping section of the lid is applied to the rim of the container. However, it may also be perpendicular to the side wall, as in the embodiment of FIGS. 3 and 4, described below.

As further seen in FIG. 2, an annular gasket 30 is provided between the rim 13 of the container, and the juncture of the inner and outer walls 24, 25 of clamping section 22 of the lid 20. Gasket 30 is preferably made of a rubber or elastomeric resin so as to effectively seal the interface between the container rim 13 and the lid clamping section 22.

FIG. 2 illustrates the optional inclusion of a plurality of clamping elements 40 applied around the circumference of the clamping section 22 of the lid 20. Each clamping element has in-turned ends 41, 42 applied over the opposite ends of outer wall 25 of the lid clamping section 22 to reinforce the clamping action of the lid 20 with respect to the container 10. Since clamping elements 40 are optional, they are omitted from FIGS. 1, 3, and 4.

The above described structure of the container 10 and its lid 20 enables the lidded container to withstand considerable internal pressure, even though the structural elements are made of plastic and of relatively thin material. Thus, the pressure within the container, indicated by arrow $P_1$ in FIG. 2, tends to press wall 24 of the lid clamping section 22 against the inner surface of container side wall 11. This action is enhanced by the elastic deformation of the juncture section 23 between the lid central section 21 and the lid clamping section 22. The internal pressure $P_1$ also tends to deform the upper end of the container side wall 11 in the outward direction towards the outer wall 25 of the lid clamping section 22. As a result, the higher the internal pressure $P_1$ within the container, the stronger will be the clamping action between the lid clamping section 22 and the container rim section 13. This clamping action is further enhanced by the rib 14 at the upper end of the container wall 11, and the outwardly-extending rib 26 at the lower end of wall 25 of the lid clamping section 22. This clamping action may be even further enhanced by the optional clamping elements 40 applied around the opposite ends of wall 25 of the lid clamping section 22.

In addition, the annular gasket 30 between the rim 13 of the container 10, and the juncture of the inner and outer walls 24, 25 of the lid clamping section 22, produces a seal between the lid and the container, preventing the leakage of pressure/material from the container, and the entry of air into the container.

As shown in FIG. 2, the inner pressure $P_1$ pushes lid central region 21 upwardly. The elastic structure of wall 23 and its specific connection point to section 22, make lid wall 25 to be pressed against container wall 11 to thereby firmly press rib 26 against rib 14. As a result, an increase in the internal pressure also increases the seal between ribs 14 and 26, and section lid 22 to section container 13.

Figure 3:
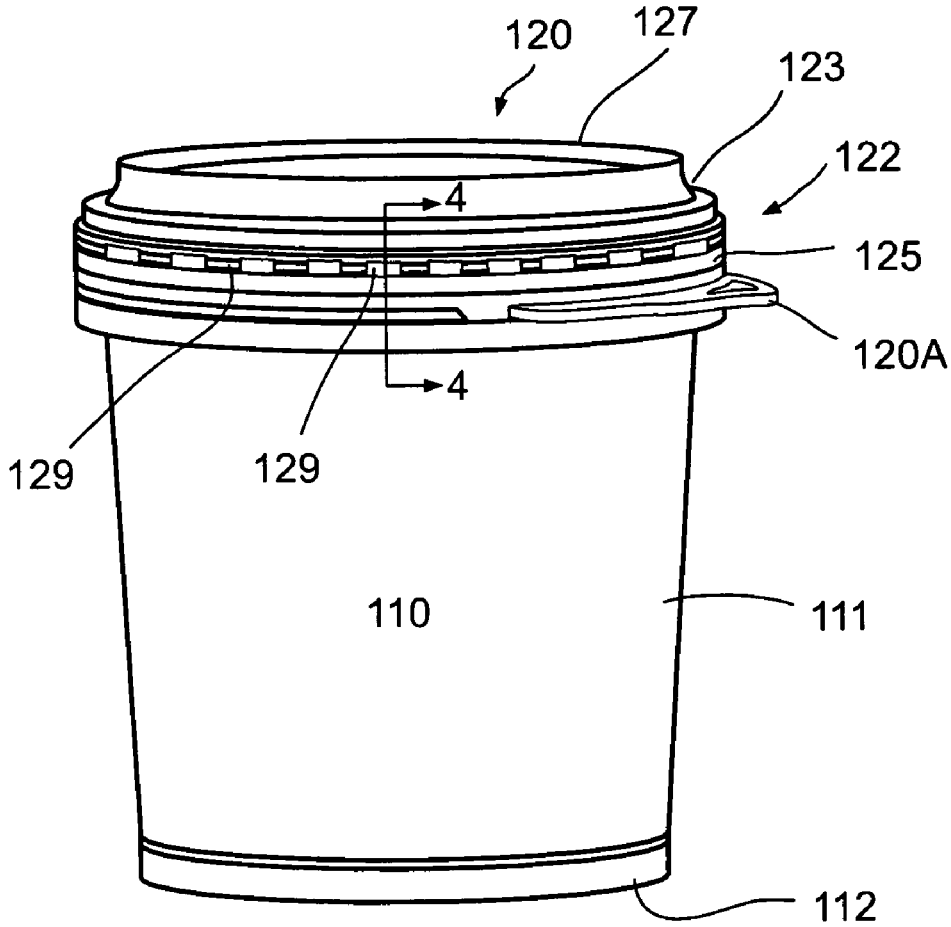
FIG. 3 illustrates another lidded container constructed in accordance with the present invention.
Figure 4:
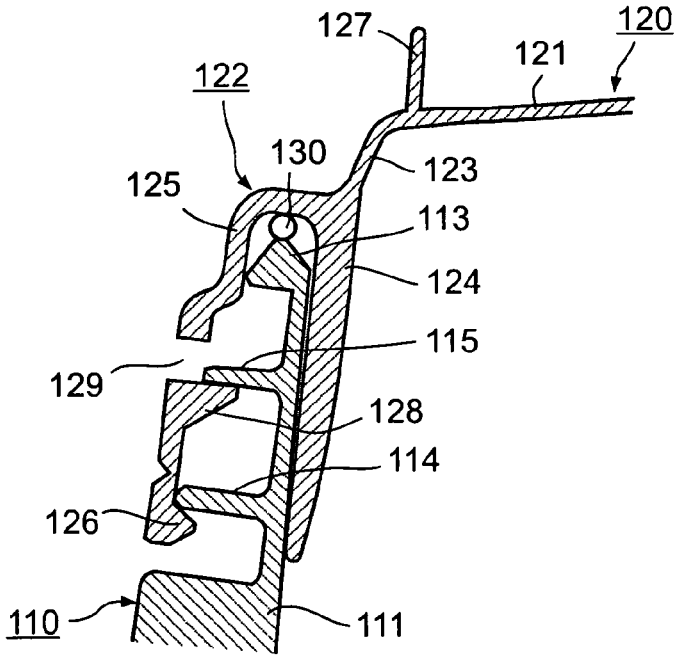
FIG. 4 is an enlarged fragmentary view along lines 4-4 of FIG. 3, and particularly illustrates the clamping structure between the lid and container in the lidded container of FIG. 3.

FIGS. 3 and 4 illustrate a lidded container similar to that of FIGS. 1 and 2 but including several modifications. To facilitate understanding, the parts illustrated in FIGS. 3 and 4 generally corresponding to the parts in FIGS. 1 and 2 are identified by the same reference numerals, but increased by "100". The additional parts included in the construction of FIGS. 3 and 4 are identified by additional reference numbers also in the "100" series.

Thus, the lidded container illustrated in FIGS. 3 and 4 also includes a container generally designated 110 and a lid generally designated 120. The container includes a side wall 111, a bottom wall 112, an annular rim 113 (FIG. 4) at its upper end, and an outwardly projecting rib 114. Similarly, the lid 120 includes a central section 121, a clamping section 122 joined to the central section by a juncture section 123, an inner wall 124 of the clamping section 122, an outer wall 125 of the clamping section 122, a rib 126 engageable with rib 114 of the container, and a sealing ring or gasket 130 between the rim 113 of the container and the juncture of the two walls 124, 125 of clamping section 122 of the lid.

The following modifications are included in the lidded container illustrated in FIGS. 3 and 4.

With respect to the container 110, its rib 114, as shown particularly in FIG. 4, extends substantially perpendicularly to the longitudinal axis of the container, rather than at an angle directed downwardly towards the bottom of the container as shown in FIG. 2.

Figure 5:
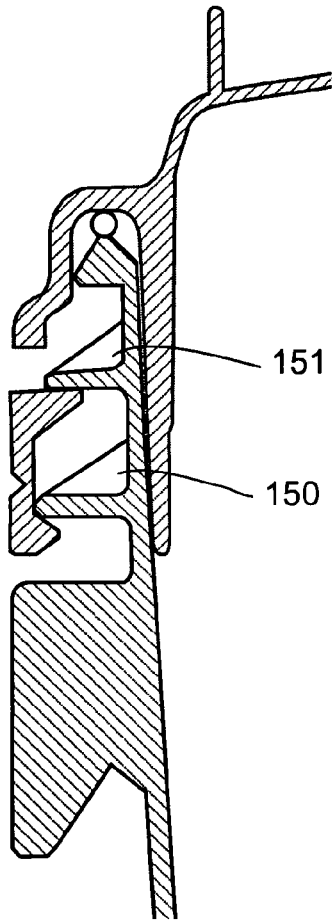
FIG. 5 illustrates a modification of FIG. 4.

In addition, container 110 is formed with a further, intermediate rib 115, between rib 114 and its rim 113. Rib 115 also extends substantially perpendicularly to the longitudinal axis of the container, i.e., substantially parallel to container rib 114. A higher internal pressure causes elements 126 and 128 to press upwardly against elements 114 and 115. In order to reinforce the resistance of elements 114 and 115 to this upward force, reinforcement ribs 150 and 151 may be added as shown in FIG. 5.

With respect to lid 120 shown in FIG. 4, its juncture section 123 between the central section 121 of the lid and the clamping section 122, is closer to the thickness of the central section 121 of the lid; i.e., it is substantially of the same thickness or only slightly thinner. To increase the deformability of the juncture section 123 of the lid, the lid is formed with an annular axial rib 127 extending outwardly and substantially coaxial to the longitudinal axis of the container and located at the juncture between the central section 121 of the lid, and its deformable juncture section 123. Axial rib 127 thus increases the stiffness of the lid even if made thinner than in FIGS. 1 and 2, and enhances the deformability of its juncture section 123 when subjected to the internal pressure within the container. Axial rib 127 also enhances the functioning of juncture section 123, when subject to internal pressure, to more evenly distributed such pressure to the entire closure system, to enable it to operate more evenly and balanced all over the circumference of the container. Axial rib 127 also serves to locate one lidded container over the other when stacking a plurality of such lidded containers.

According to another feature particularly shown in FIG. 4, wall 125 of the lid clamping section 122 is formed with an intermediate rib or ledge 128 underlying rib 115, and also with a peripheral array of slots or windows 129 each aligned with rib 115 of the container. Such an arrangement provides additional support for the lid, when the container is subjected to a high internal pressure. The slots or windows 129 facilitate the formation of rib or ledge 128.

As shown in FIG. 3, lid 120 is also formed with a pair of handles 120*a* (only one is seen) to facilitate removing the lid from the container. Carry handles could also be provided in the construction of FIGS. 1 and 2, as well as that of FIGS. 3 and 4.

In substantially all other respects, the lidded container illustrated in FIGS. 3 and 4 is constructed and operates as, and provides the advantages of, the lidded container illustrated in FIGS. 1 and 2.

While the invention has been described with respect to two preferred embodiments, it will be appreciated that these are set forth merely for purposes of example, and that many other variations, modifications and applications of the invention may be made.

What is claimed is:

1. A lidded container comprising: a container having a side wall, an integral closed bottom wall, and an open top defined by an annular rim; and a lid having a central section and an outer rim attachable to the annular rim of the container;

said outer rim of the lid including an annular clamping section defined by spaced inner and outer walls, joined together at one end and non-joined at an opposite end, for receiving the annular rim of the container in the space between the walls: characterized in that:

said lidded container further comprises an annular gasket between the annular rim of the container and the juncture of the inner and outer spaced walls of the annular clamping section of said lid;

said central section of the lid is normally of an outwardly dome-shaped convex configuration; and said one end of the annular clamping section of the lid is integrally joined to said central section of the lid by an annular, elastically deformable juncture section effective (a) to increase the clamping action of said clamping section, and (b) the sealing action of said annular gasket with an increase in pressure within the container.

2. The lidded container according to claim 1, wherein: said open top of the container is integrally formed on its outer surface with an outwardly projecting rib slightly spaced from said annular rim; and said outer wall of the lid clamping section is integrally formed on its inner surface with an annular rib to underlie said rib of the container and thereby to enhance the clamping action of the clamping section of the lid with an increase in pressure within the container.

3. The lidded container according to claim 2, wherein said rib of the container is angled downwardly towards the bottom wall of the container, and said annular rib or the lid is angled upwardly towards said annular rim of the container.

4. The lidded container according to claim 1, wherein said annular elastic juncture section of the lid is thinner than the central section of the lid to thereby increase the deformability of said juncture section.

5. The lidded container according to claim 1, wherein said lid is integrally formed with an axially-extending annular rib, between the central section of the lid and said annular elastic juncture section, to thereby increase the stiffness of said central section, and to facilitate stacking a plurality of such lidded containers.

6. The lidded container according to claim 5, wherein said container is integrally formed, between its annular rim and said rib of the container, with an intermediate rib substantially perpendicular or outwardly projecting angled slightly downwards to the axis of the container; and wherein said lid is formed with a peripheral array of slots or windows each aligned with said intermediate rib of the container, and with a ledge to underlie said intermediate rib of the container.

7. The lidded container according to claim 1, wherein said container and lid are both of a plastic material.

8. The lidded container according to claim 2, wherein said rib of the container, and said annular rib of the lid are substantially perpendicular or outwardly projecting angled slightly downwards to the axes of the container and lid, respectively.

9. The lidded container according to claim 1, wherein said lidded container further comprises clamping elements each having opposite ends applied over opposite ends of the outer wall of said annular clamping section of the lid to reinforce the clamping action of said clamping section.

* * * * *